United States Patent [19]

Rümmele

[11] Patent Number: 4,484,434

[45] Date of Patent: Nov. 27, 1984

[54] MOVABLE CLEANING APPARATUS FOR DRAFTING MECHANISM OF SPINNING AND TWISTING MACHINES

[75] Inventor: Winfried Rümmele, Bürs, Austria

[73] Assignee: Sohler Airtex GmbH, Wangen, Fed. Rep. of Germany

[21] Appl. No.: 409,171

[22] Filed: Aug. 18, 1982

[51] Int. Cl.[3] ..... D01H 11/00

[52] U.S. Cl. ..... 57/304; 15/312 R

[58] Field of Search ..... 57/300, 303, 304, 305; 15/312 R, 312 A

[56] References Cited

U.S. PATENT DOCUMENTS

| | | | |
|---|---|---|---|
| 3,245,103 | 4/1966 | King | 15/312 A |
| 3,276,065 | 10/1966 | King et al. | 15/312 A |
| 3,317,947 | 5/1967 | Jacobi et al. | 15/312 A |
| 3,429,745 | 2/1969 | Black | 57/304 X |
| 3,432,877 | 3/1969 | Black et al. | 57/304 X |

*Primary Examiner*—Donald Watkins

*Attorney, Agent, or Firm*—Becker & Becker, Inc.

[57] ABSTRACT

A cleaning apparatus which is movable along a spinning machine having numerous drafting mechanisms. The cleaning apparatus has air jets directed onto the drafting mechanism to loosen lint or fiber fly, which is taken up by suction openings. First air jets are arranged above and below the working or operating region of the drafting mechanism; these air jets respectively produce a horizontal air veil in order to prevent the fiber fly from being blown onto adjacent machine parts, or onto the floor of the workshop. Additionally, a second jet produces a strong flat air stream which essentially extends at right angles to the horizontal air veils of the first air jets, and extends approximately in the center thereof. A row of suction mouthpieces is respectively provided on both sides of the flat air stream of the second air jet.

8 Claims, 3 Drawing Figures

MOVABLE CLEANING APPARATUS FOR DRAFTING MECHANISM OF SPINNING AND TWISTING MACHINES

The present invention relates to a movable cleaning apparatus for drawing rollers or drafting mechanisms of spinning and twisting machines, especially drafting or ring spinning frames, whereby in the working region of the drafting mechanism there are provided air jets and at least one suction opening for the fiber fly or lint.

With a known apparatus which is movable on rails, discharge nozzles are provided which sweep over the working location for pneumatically blowing-off and suctioning-off fiber fly. The fiber fly resulting and deposited for example in the region of the drafting mechanism is raised or whirled-up and falls onto the machine parts located therebelow, and especially onto the floor, from where it is taken up by means of suction mouthpieces provided on long suction pipes suspended from the cleaning apparatus, which is movable above the spinning machine. Although it is known, with a cleaning apparatus which is movable laterally along the machine, to provide a single suction opening for fiber fly approximately in the working region of the drafting mechanism, this suction opening only has a small operating range and consequently is not very effective.

It is therefore an object of the present invention to concentrate fiber fly in the working region of the drafting mechanism, and to remove it directly.

This object, and other objects and advantages of the present invention, will appear more clearly from the following specification in connection with the accompanying drawings, in which.

The cleaning apparatus of the present invention is characterized primarily in that first air jets are arranged above and below the working region of the drafting mechanism; these air jets respectively produce a horizontal air veil; a discharge nozzle or second air jet produces a flat air stream which extends essentially at right angles to the horizontal air veils of the first air jets, and extends approximately between them; a row of suction mouthpieces is respectively provided on both sides of the flat air stream of the second air jet.

In this way there is attained the advantage that lint or fiber fly and dust are concentrated within the working region of the drafting mechanism, and when blown off no longer fall onto the floor of the workshop or onto machine parts which, like a ring rail, are located below the drafting mechanism or drafting stand. Thus, at the same time dust and fiber fly is prevented from discharging upwardly or toward the sides from the immediate working region of the drafting mechanism. Experience has shown that most of the fiber fly occurs at the drafting mechanism; this fiber fly deposits, for instance, on the drafting stand just when the cleaning apparatus is cleaning a different drafting mechanism. The air stream given off by the air jets and directed onto the rollers of the drafting mechanism can be quite strong, since the fiber fly released or removed thereby is guided outwardly directly into the suction mouthpieces arranged on both sides thereof. The central cleaning stream and the drafting mechanism are thus surrounded on all sides by blocking air veils.

The second air jet for producing the flat air stream may be a slotted nozzle or jet which is arranged on an adjustable ball end.

The first air jets for producing the fan-shaped air veils may be arranged on a blow tube which is suspended or hangs down from a cleaning unit which is movable above the spinning and twisting machine. The second air jet may be arranged on the free end of a shorter blow tube which likewise hangs down from the cleaning unit. Suction tubes may hang down from the cleaning unit; these suction tubes may be arranged on both sides of the blow tubes, and may respectively have at least two suction mouthpieces.

The movable cleaning unit may extend bilaterally or on two sides above the machine or spinning frame, and may have blow tubes and suction tubes hanging down on both sides of the machine. The first air jets for producing the horizontal fan-shaped air veil may be arranged at the same height on both sides of the machine or ring spinning frame.

The first air jets, the blower nozzle or second air jet, and the suction mouthpieces may be brought to the drafting mechanism yet permit the cleaning apparatus to travel beyond the machine housing at the ends of the ring spinning frame or machine.

Figure 1:
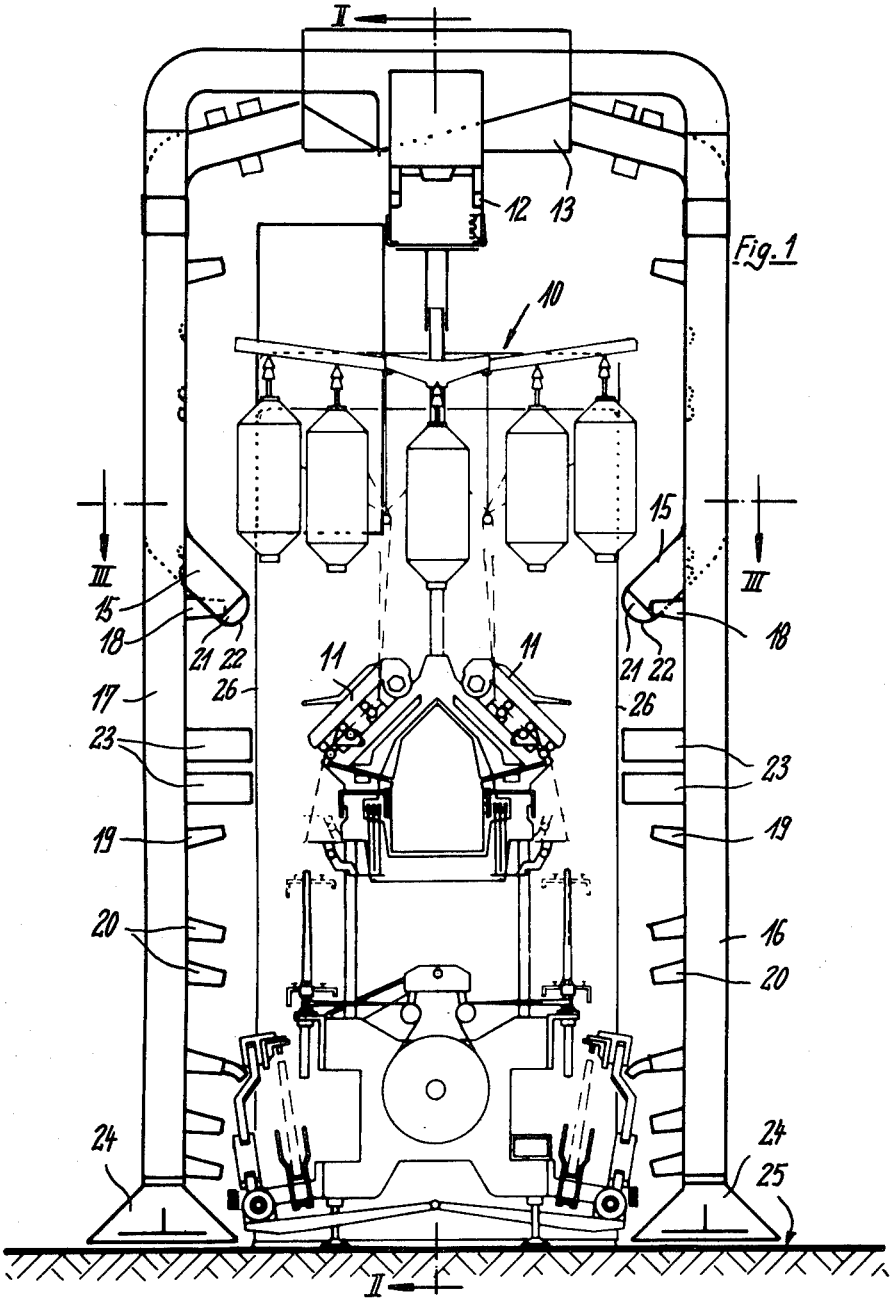
FIG. 1 illustrates a ring spinning frame which is equipped with one embodiment of the cleaning apparatus of the present invention.

Referring now to the drawings in detail, the ring spinning frame 10 illustrated in cross section in FIG. 1 is provided with drafting mechanisms 11. Rails or tracks 12 are arranged above the ring spinning frame 10; a cleaning device or unit 13 can move on the rails 12 in the longitudinal direction of the ring spinning frame 10. The cleaning unit 13 is constructed bilaterally, and accordingly has blow tubes 14 and 15 as well as suction tubes 16 and 17 suspended or hung on both sides of the ring spinning frame 10.

Figure 2:
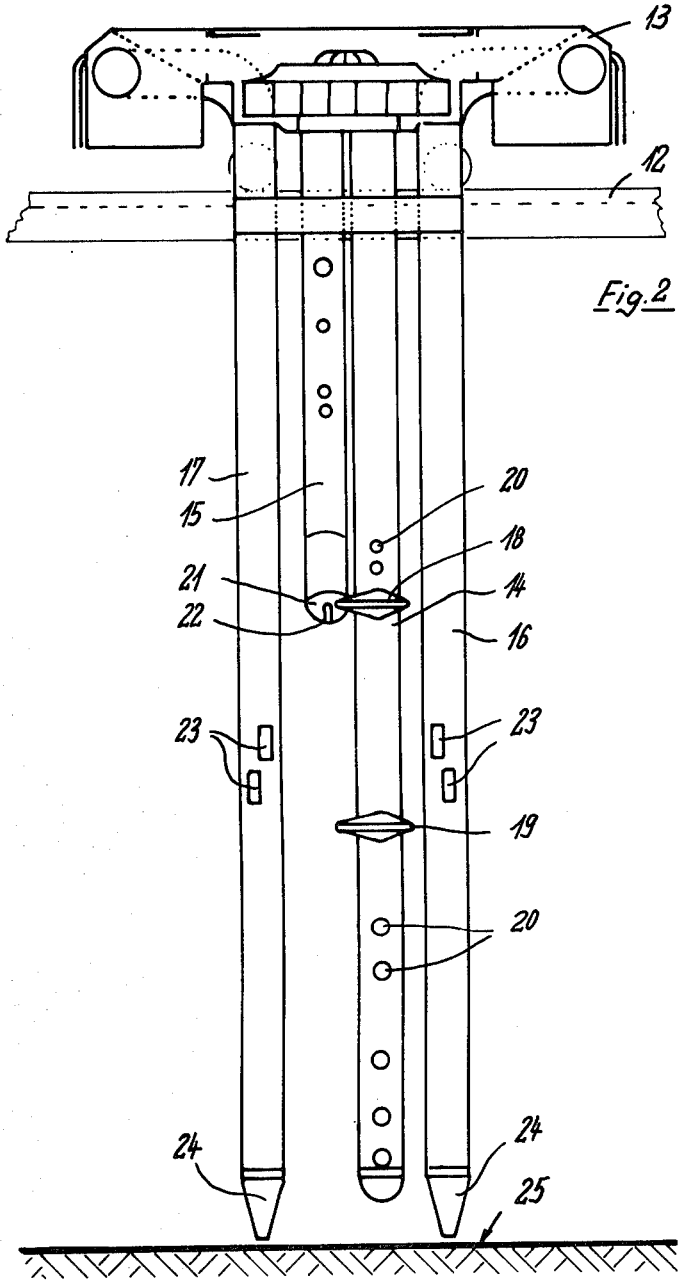
FIG. 2 is a section taken along line II—II in FIG. 1, with the ring spinning frame being omitted.
Figure 3:
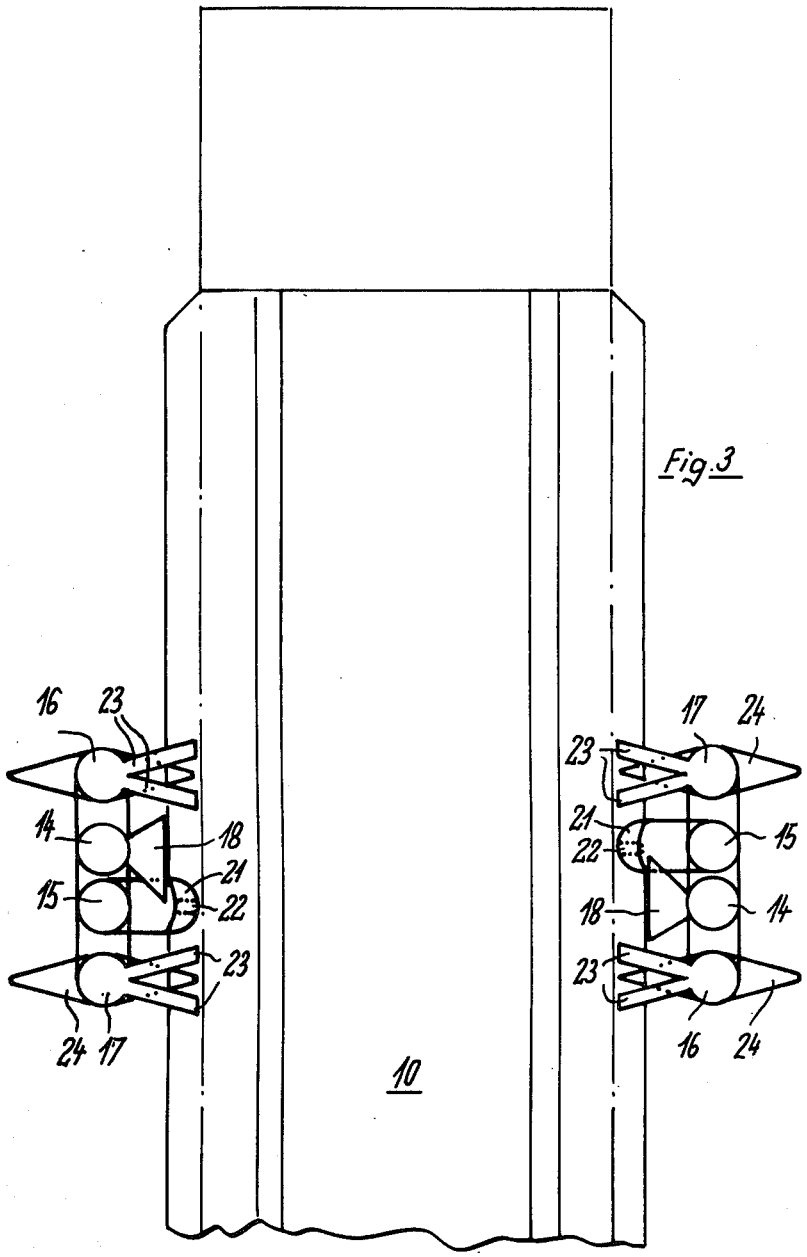
FIG. 3 is a section taken along line III—III in FIG. 1.

As clearly shown in FIG. 2, the blow tube 14 has air jets or slotted nozzles 18 and 19 which produce a non-illustrated, horizontal, fan-shaped air current or veil below the working region of the drafting rollers or drafting mechanism 11. The fan-shaped air veil preferably has an opening angle which is dimensioned in such a way that blocking air veils are formed above and below the working region of the drafting mechanism 11 at least between the suction tubes 16 and 17 located across from each other on both sides of the ring spinning frame 10.

The blow tube 14 can have further smaller air jets 20 above and/or below the portion thereof located between the slotted nozzles or air jets 18 and 19.

The blow tube 15 is considerably shorter than the blow tube 14, and opens into an adjustable ball end 21 which carries an air or blower jet 22. The blower jet 22 is constructed and arranged in such a way that it delivers a strong flat air stream which essentially extends at right angles to the horizontal air veils of the slotted nozzles or air jets 18 and 19, and which is arranged approximately between the horizontal air veils. For this purpose, the blow tube 15 is located in the immediate vicinity of the blow tube 14 between the two suction tubes 16 and 17.

Each of the suction tubes 16 and 17 has at least one suction mouthpiece or orifice 23. In the illustrated embodiment, two suction mouthpieces 23 are respectively provided in the lower region of the drafting mechanism 11; these suction mouthpieces 23 are somewhat displaced on the periphery of the suction tubes 16 and 17 with respect to height relative to one another. The suction mouthpieces 23 directed in the direction of the drafting mechanism 11 take up the fiber fly or lint from the center, while the somewhat outwardly directed suction mouthpieces take care of or pick up the same in the edge regions of the fan-shaped blocking-air veil.

As apparent from FIG. 1, the free end of the shorter blow tube 15 can be inclined in the direction of the drafting mechanism 11. The flat cleaning-air stream discharging from the blow tube 15, i.e. from the air jet 22, directly cleans the rollers of the drafting mechanism and, loaded with dust and fiber fly, is deflected in the direction of the lateral suction tubes 16 and 17, where it enters the suction mouthpieces 23 without the dust or fiber fly being able to pass by the lower blocking air veil of the slotted nozzles or air jets 19. In this manner, the discharge or working speed of the air discharging from the jet or nozzle 22 can be increased without the danger existing that the dust and/or fiber fly would be blown onto machine parts located thereunder, such as, for example, the ring rail, and onto the floor of the workshop, where it could accumulate. Nevertheless, suction mouthpieces or orifices 24 are provided at the lower free ends of the suction tubes 16 and 17; these suction mouthpieces cover or sweep the floor 25 and take up dust and fiber fly which may have been blown off from the ring spinning frame 10 by the air jets 20.

The suction mouthpieces 23 are brought as close as possible to the drawing rollers or drafting mechanism 11. The openings thereof, however, are arranged in such a way that, as apparent from FIG. 1, the cleaning apparatus can be moved beyond the machine housing 26 at the end of the ring spinning frame 10 in order, for example to service an adjacent ring spinning frame.

The suction mouthpieces 23 are expediently arranged directly above the lower air jet 19.

Further suction mouthpieces 23 can also be arranged on the suction tubes 16 and 17 between the air jets 18 and 19.

The present invention is, of course, in no way restricted to the specific disclosure of the specification and drawings, but also encompasses any modifications within the scope of the appended claims.

What I claim is:

1. A movable cleaning apparatus for directly removing concentration of fiber fly from the working region of the drafting mechanisms of spinning and twisting machines, said apparatus comprising:

first air jets arranged above and below said working region of said drafting mechanism, each of said first air jets being adapted to produce a horizontal air veil;

a second air jet adapted to produce a flat air stream which extends essentially at right angles to said horizontal air veil of said first air jets, and approximately between them; and a vertically extending row of suction mouthpieces on each side of said flat air stream of said second air jet.

2. A cleaning apparatus according to claim 1, in which said second air jet includes slotted nozzle means respectively arranged on an adjustable ball end.

3. A cleaning apparatus according to claim 1, which includes a cleaning unit which is movably arranged above said spinning and twisting machines, and at least one blow tube which hangs down from said cleaning unit, said first air jets being arranged on said blow tube.

4. A cleaning apparatus according to claim 3, which includes at least one shorter blow tube, one end of which hangs down from said cleaning unit, the other free end of which supports said second air jet.

5. A cleaning apparatus according to claim 4, which includes suction tubes which hang down from said cleaning unit and are arranged on both sides of said blow tubes, each of said suction tubes being provided with at least two suction mouthpieces.

6. A cleaning apparatus according to claim 5, in which said cleaning unit is bilateral, and includes blow tubes and suction tubes hanging down on both sides of said machine.

7. A cleaning apparatus according to claim 6, in which said first air jets are arranged at the same height on both sides of said machine.

8. A cleaning apparatus according to claim 7, in which said first air jet, said second air jets, and said mouthpieces are close to, yet spaced from, a drafting mechanism in such a way as to permit said cleaning apparatus to travel beyond the housing at the ends of said machine.

* * * * *